US006115014A

United States Patent [19]

Aoki et al.

[11] Patent Number: 6,115,014

[45] **Date of Patent: *Sep. 5, 2000**

[54] LIQUID CRYSTAL DISPLAY BY MEANS OF TIME-DIVISION COLOR MIXING AND VOLTAGE DRIVING METHODS USING BIREFRINGENCE

[75] Inventors: Hisashi Aoki, Hamura; Soichi Sato, Ome; Tetsushi Yoshida, Kanagawa-ken; Jiro Takei, Tama, all of Japan

[73] Assignee: Casio Computer Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/576,780

[22] Filed: Dec. 21, 1995

[30] Foreign Application Priority Data

Dec. 26, 1994 [JP] Japan ..... 6-336690
Dec. 26, 1994 [JP] Japan ..... 6-336766

[51] Int. Cl.[7] ..... G09G 3/36

[52] U.S. Cl. ..... 345/88

[58] Field of Search ..... 345/88, 89, 94, 345/105, 147, 150, 148, 154, 32, 95; 349/77, 78, 80, 33, 97, 181, 96; 359/265, 267

[56] References Cited

U.S. PATENT DOCUMENTS

| | | | |
|---|---|---|---|
| 3,785,721 | 1/1974 | Harsch | 349/96 |
| 4,097,128 | 6/1978 | Matsumoto et al. | 349/78 |
| 4,232,948 | 11/1980 | Shanks | 349/78 |
| 4,917,465 | 4/1990 | Conner et al. | 349/80 |
| 5,191,454 | 3/1993 | Iijima et al. | 349/33 |
| 5,204,664 | 4/1993 | Hamakawa | 345/154 |
| 5,309,170 | 5/1994 | Takashi et al. | 345/88 |
| 5,537,256 | 7/1996 | Fergason | 345/32 |
| 5,550,660 | 8/1996 | Yang | 349/96 |
| 5,559,617 | 9/1996 | Mitsui et al. | 349/96 |
| 5,583,678 | 12/1996 | Nishino et al. | 345/95 |
| 5,585,950 | 12/1996 | Nishino et al. | 345/88 |
| 5,757,347 | 5/1998 | Han | 345/88 |
| 5,796,378 | 8/1998 | Yoshida et al. | 345/88 |
| 5,818,557 | 10/1998 | Konuma et al. | 349/93 |

*Primary Examiner*—Steven J. Saras
*Assistant Examiner*—Paul A. Bell
*Attorney, Agent, or Firm*—Frishauf, Holtz, Goodman, Langer & Chick, P.C.

[57] ABSTRACT

One frame of a video signal is separated to a plurality of display frames. To display a color specified by the video signal by mixing display colors of a plurality of display frames, the video signal is converted to data indicative of a voltage to be applied to each pixel over the display frames by using a conversion table. A voltage corresponding to the converted data is applied to a birifringence control type liquid crystal display device to drive the liquid crystal display device multiple times in one frame period of the video signal. When the response speed of the liquid crystal is fast, a color obtained by mixing the display colors of a plurality of display frames is recognized by an observer. When the response speed of the liquid crystal is slow, a color corresponding to an average value of the voltages applied to a plurality of display frames is recognized by the observer. When the liquid crystal has an intermediate response speed, a color obtained by visually mixing a series of display colors displayed during the transition of the alignment state of the liquid crystal is recognized by the observer.

9 Claims, 16 Drawing Sheets

ANALOG VIDEO SIGNAL
WRITE CIRCUIT
15
R 2
G 2
B 2
ODD-NUMBERED FRAME MEMORY
17A
EVEN-NUMBERED FRAME MEMORY
17B
17
CONTROLLER
13
VOLTAGE DATA GENERATOR
19
3
VOLTAGE GENERATOR
21
V4
V3
V2
V1
V0
MULTIPLEXER
23
DRIVING CIRCUIT
11
LCD DEVICE
25
COLUMN DRIVER
33
ROW DRIVER
35
49
45
43
47
41
31

FIG.6

MONOCHROMATIC CONVERSION TABLE 81

| ADDRESSES | | | | | | STORED DATA (VOLTAGE DATA) | | | VOLTAGES TO BE SELECTED (BASIC COLORS) |
|---|---|---|---|---|---|---|---|---|---|
| R1 | R2 | G1 | G2 | B1 | B2 | | | | |
| 0 | 0 | 0 | 0 | 0 | 0 | 0 | 1 | 1 | V3(BLACK) |
| 0 | 0 | 0 | 0 | 1 | 0 | 0 | 1 | 0 | V2(BLUE) |
| 0 | 0 | 1 | 0 | 0 | 0 | 0 | 0 | 1 | V1(GREEN) |
| 1 | 0 | 0 | 0 | 0 | 0 | 0 | 0 | 0 | V0(RED) |
| 1 | 1 | 1 | 1 | 1 | 1 | 1 | 0 | 0 | V4(WHITE) |

MIXED-COLOR CONVERSION TABLE 82

| ADDRESSES | | | | | | STORED DATA (VOLTAGE DATA) | | | VOLTAGES TO BE SELECTED (COLORS) | | |
|---|---|---|---|---|---|---|---|---|---|---|---|
| R1 | R2 | G1 | G2 | B1 | B2 | 1st DISPLAY FRAME | 2nd DISPLAY FRAME | 3rd DISPLAY FRAME | 1st DISPLAY FRAME | 2nd DISPLAY FRAME | 3rd DISPLAY FRAME |
| 0 | 0 | 0 | 0 | 0 | 1 | 0 1 0 | 0 1 1 | 0 1 0 | V2 (BLUE) | V3 (BLACK) | V2 (BLUE) |
| 0 | 0 | 0 | 0 | 1 | 1 | 0 1 0 | 1 0 0 | 0 1 0 | V2 (BLUE) | V4 (WHITE) | V2 (BLUE) |
| 0 | 0 | 0 | 1 | 0 | 0 | 0 0 1 | 0 1 1 | 0 0 1 | V1 (GREEN) | V3 (BLACK) | V1 (GREEN) |
| | | ⋮ | | | | ⋮ | ⋮ | ⋮ | ⋮ | ⋮ | ⋮ |
| 1 | 1 | 1 | 1 | 1 | 0 | 0 1 0 | 0 0 1 | 0 0 0 | V2 (BLUE) | V1 (GREEN) | V0 (RED) |

FIG.13

COLOR/VOLTGE CONVERSION TABLE 270

| ADDRESSES | | | | | | STORED DATA (VOLTAGE DATA) |
|---|---|---|---|---|---|---|
| R1 | R2 | G1 | G2 | B1 | B2 | |
| 0 | 0 | 0 | 0 | 0 | 0 | 0 0 0 0 |
| 0 | 0 | 0 | 0 | 0 | 1 | 0 0 1 0 |
| | | | ⋮ | | | ⋮ |
| 0 | 0 | 1 | 1 | 1 | 1 | 0 1 1 1 |
| | | | ⋮ | | | ⋮ |
| 1 | 1 | 1 | 1 | 1 | 1 | 1 1 1 0 |

FIG.14

280

| ADDRESSES | | | | | | VOLTAGE DATA FOR ODD-NUMBERED FRAME | | | VOLTAGE DATA FOR EVEN-NUMBERED FRAME | | |
|---|---|---|---|---|---|---|---|---|---|---|---|
| R1 | R2 | G1 | G2 | B1 | B2 | | | | | | |
| 0 | 0 | 0 | 0 | 0 | 0 | 0 | 0 | 0 | 0 | 0 | 0 |
| 0 | 0 | 0 | 0 | 0 | 1 | 0 | 0 | 1 | 0 | 0 | 1 |
| | | | ⋮ | | | | ⋮ | | | ⋮ | |
| 0 | 0 | 1 | 1 | 1 | 1 | 0 | 1 | 1 | 1 | 0 | 0 |
| | | | ⋮ | | | | ⋮ | | | ⋮ | |
| 1 | 1 | 1 | 1 | 1 | 1 | 1 | 1 | 1 | 1 | 1 | 1 |

FRAME COUNTER 281

FIG.16

| ADDRESSES | | | | | | STORED DATA (VOLTAGE DATA) |
|---|---|---|---|---|---|---|
| R1 | R2 | G1 | G2 | B1 | B2 | |
| 0 | 0 | 0 | 0 | 0 | 0 | 0 0 0 0 0 0 |
| 0 | 0 | 0 | 0 | 0 | 1 | 0 0 1 0 0 1 |
| 0 | 0 | 0 | 0 | 1 | 0 | 0 0 1 1 1 0 |
| 0 | 0 | 0 | 0 | 1 | 1 | 0 0 1 1 1 1 |
| | | | ⋮ | | | ⋮ |
| 1 | 1 | 1 | 1 | 1 | 1 | 1 1 1 1 1 1 |

LIQUID CRYSTAL DISPLAY BY MEANS OF TIME-DIVISION COLOR MIXING AND VOLTAGE DRIVING METHODS USING BIREFRINGENCE

BACKGROUND OF THE INVENTION

1. Field of the Invention

The present invention relates to a color liquid crystal apparatus using a liquid crystal display device for displaying colors according to applied voltages, and a method of driving the same.

2. Description of the Related Art

Ordinary color liquid crystal display (LCD) devices are equipped with color filters for three primary colors so that the intensities of lights passing the color filters are controlled to provide arbitrary display colors.

LCD display devices equipped with color filters suffer dark display because light is absorbed by the color filters. The LCD devices are therefore inadequate as reflection type LCD device devices.

A birifringence control type LCD device is known which can present a plurality of colors without using color filters. The birefringence control type LCD device comprises an LC cell obtained by sealing liquid crystal, subjected to an aligning treatment, between a pair of electrodes-formed substrates, and two polarization plates so arranged as to sandwich the LC cell.

The birefringence control type LCD device alters the molecular alignment of the liquid crystal by applying an electric field to the liquid crystal, so that the spectrum distribution of the light leaving a pair of polarization plates is changed, thereby displaying the desired colors.

Since the birifringence control type LCD device presents bright display, it can be realized as a reflection type color LCD apparatus. This birefringence control type LCD device also has an advantage of having a simple structure.

But, the colors displayable by the conventional birefringence control type LCD device are determined by the applied voltages. Therefore, the types or number of displayable colors is limited to the number of the applied voltages so that a difference is likely to occur between the desired display color and the actually displayed color. Further, increasing the types of applied voltages to increase the number of display colors result in greater consumed power.

Even the colors displayable by controlling the applied voltages may not be displayed stably because the ranges of the applied voltages that are used to display those colors are narrow or the alignment of the liquid crystal becomes unstable.

SUMMARY OF THE INVENTION

Accordingly, it is an object of the present invention to provide an LCD apparatus, which can stably display arbitrary colors, and a method of driving the same.

It is another object of this invention to provide an LCD apparatus capable of displaying colors which are not permitted to be displayed by the applied voltages v.s. display colors characteristics, and a method of driving the same.

It is a further object of this invention to provide an LCD apparatus capable of displaying multiple colors with low consumed power, and a method of driving the same.

It is a still further object of this invention to provide an LCD apparatus which reduces the difference or error between a desired color and an actually displayed color, and a method of driving the same.

To achieve the above objects, according to the first aspect of this invention, there is provided an LCD apparatus comprising:

a liquid crystal display device having a plurality of pixels arranged in a matrix form, for displaying a plurality of colors in accordance with applied voltages pixel by pixel;

display color designating means for designating display colors for the plurality of pixels;

conversion means for converting a display color designated by the display color designating means to data indicating a voltage to be applied to an associated pixel over a plurality of frames in order to display the display color of the associated pixel by mixing plural frames of display colors; and drive means for applying a voltage corresponding to data from the conversion means to the liquid crystal display device to display the display color of each pixel by mixing plural frames of display colors of the pixel.

According to this invention, desired colors can be displayed by mixing plural frames of display colors so that a greater number of colors than the number of applied voltages can be displayed. It is also possible to display colors which cannot normally be displayed by simple alteration of the applied voltages.

Because the periods of display frames are short, mixed colors may be achieved by visual color mixture (combination) by an observer.

The display colors may be established frame by frame, or may be recognized by visual combination of display colors which continuously change in accordance with a change in the alignment of the liquid crystal which is caused by the applied voltage.

According to the second aspect of this invention, there is provided an LCD apparatus comprising:

a liquid crystal display device having a plurality of pixels arranged in a matrix form, for displaying a plurality of colors in accordance with applied voltages pixel by pixel;

image data supply means for supplying image data defining display colors of individual pixels of the liquid crystal display device;

color-voltage converting means for converting the image data to voltage data; and drive means for applying a voltage corresponding to the voltage data to the liquid crystal display device, whereby each pixel of the liquid crystal display device displays a color corresponding to an average value of voltages applied over a plurality of frames by the drive means.

According to this invention, colors corresponding to the average value of the applied voltages over a plurality of frames are displayed. Therefore, a greater number of colors than the number of applied voltages can be displayed.

According to the third aspect of this invention, there is provided an LCD apparatus comprising:

a liquid crystal display device having a plurality of pixels arranged in a matrix form, for displaying a plurality of colors in accordance with applied voltages pixel by pixel;

image data supply means for supplying plural pieces of image data corresponding to a plurality of colors and defining display colors of individual pixels of the liquid crystal display device;

error memory means for storing error data between display colors defined by the image data and colors displayed by the pixels, for the plurality of colors;

adding means for, every time image data is supplied from the image data supply means, adding the image data and error data corresponding to the image data and previously stored in the error memory means; and voltage applying means for applying a voltage for displaying a color corresponding to that piece of added data among plural pieces of added data from the adding means corresponding to the plurality of colors, which is greater than a predetermined value, to an associated pixel of the liquid crystal display device.

With this structure, the voltages to be applied to the individual pixels are determined in consideration of the error for each color, so that colors close to desirable colors can be displayed.

According to the fourth aspect of this invention, there is provided an LCD apparatus comprising:

a liquid crystal display device having a plurality of pixels arranged in a matrix form, for displaying a plurality of colors in accordance with applied voltages pixel by pixel;

image data supply means for supplying plural pieces of image data corresponding to a plurality of colors and defining display colors of individual pixels of the liquid crystal display device;

error memory means for storing errors between display colors defined by the plural pieces of image data and colors displayed by the pixels, display color by display color;

adding means for adding the image data and associated errors for associated colors to acquire a plurality of added values;

voltage applying means for applying a voltage for displaying one of the plurality of colors to a pixel designated by the image data, based on the plurality of added values obtained by the adding means; and error setting means for setting error data corresponding to an error between a display color defined by the plural pieces of image data and an associated display color for each of the plurality of added values obtained by the adding means.

With this structure, the voltages to be applied to the individual pixels are determined in consideration of the error for each color, so that colors close to desirable colors can be displayed.

According to the fifth aspect of this invention, there is provided an LCD apparatus comprising:

a liquid crystal display device having a plurality of pixels arranged in a matrix form, for displaying a plurality of colors in accordance with applied voltages pixel by pixel;

image data supply means for supplying image data defining display colors of individual pixels of the liquid crystal display device;

color-voltage converting means for converting the image data to voltage data indicative of a voltage for displaying a color specified by the image data;

error memory means for storing error data;

adding means for adding voltage data and the error data and outputting added data;

voltage applying means for selecting a voltage whose value is close to a value indicated by the added data from a predetermined number of voltages and applying the selected voltage to an associated pixel of the liquid crystal display device; and means for storing a difference between the added data and a value of the applied voltage as error data into the error memory means.

With this structure, the voltages to be applied to the individual pixels are determined in consideration of errors, so that colors close to desirable colors can be displayed.

According to the sixth aspect of this invention, there is provided a method of driving a liquid crystal display device for displaying colors in accordance with applied voltages pixel by pixel, comprising:

a display color designating step for designating display colors of individual pixels;

a conversion step for outputting data corresponding to plural frames of display colors to display display colors designated by the display color designating step by mixed colors of plural frames of display colors of each pixel; and a step of driving the liquid crystal display device in accordance with data output by the conversion step, whereby display colors designated by the display color designating step are displayed by mixed colors of plural frames of display colors of each pixel.

According to this invention, desired colors can be displayed by mixing plural frames of display colors so that a greater number of colors than the number of applied voltages can be displayed. It is also possible to display colors which cannot normally be displayed by simple alteration of the applied voltages.

According to the seventh aspect of this invention, there is provided a method of driving a liquid crystal display device having a plurality of pixels arranged in a matrix form for displaying a plurality of colors in accordance with applied voltages pixel by pixel, which method comprises a step of:

applying a plurality of voltages to individual pixels of the liquid crystal display device for a shorter period of time than a time needed for changing alignment of the liquid crystal display device, in such a way that an average value of the plurality of voltages becomes a voltage for displaying a color specified by image data.

According to the eight aspect of this invention, there is provided a method of driving a liquid crystal display device having a plurality of pixels arranged in a matrix form for displaying a plurality of colors in accordance with applied voltages pixel by pixel, which method comprises:

a step of supplying plural pieces of image data corresponding to a plurality of colors defining display colors of individual pixels of the liquid crystal display device;

an adding step of adding plural pieces of image data and associated plural pieces of error data stored in advance to obtain added values;

a voltage applying step of applying a voltage for displaying a color corresponding to an added value among the plurality of added values, which is equal to or greater than a predetermined value, to an associated pixel of the liquid crystal display device; and a step of subtracting the predetermined value from an added value among the plurality of added values, which is equal to or greater than the predetermined value, storing a resultant value as error data for an associated color, and storing added values smaller than the predetermined value as error data for associated colors.

With this structure, the voltages to be applied to the individual pixels are determined in consideration of the error for each color, so that colors close to desirable colors can be displayed.

According to the ninth aspect of this invention, there is provided a method of driving a liquid crystal display device having a plurality of pixels arranged in a matrix form for displaying a plurality of colors in accordance with applied voltages pixel by pixel, which method comprises the steps of:

obtaining a voltage to be applied to each pixel-for displaying a color specified by image data;

adding the voltage to be applied and a previously set error voltage to provide an added value; and applying a voltage having a value close to the added value among a plurality of predetermined voltages to an associated pixel and setting a difference between the added value and the voltage whose value is close to the added value, as a new error voltage for the associated pixel.

With this structure, the voltages to be applied to the individual pixels are determined in consideration of errors, so that colors close to desirable colors can be displayed.

BRIEF DESCRIPTION OF THE DRAWINGS

FIG. 6 is a diagram exemplifying the structure of a monochromatic conversion table;

FIG. 13 is a diagram showing one example of a color/voltage conversion table;

FIG. 14 is a diagram showing another example of the color/voltage conversion table;

FIG. 16 is a diagram showing one example of a color/voltage conversion table shown in FIG. 15.

DETAILED DESCRIPTION OF THE PREFERRED EMBODIMENTS

First Embodiment

An LCD apparatus according to the first embodiment of this invention will now be described with reference to the accompanying drawings.

Figure 1:
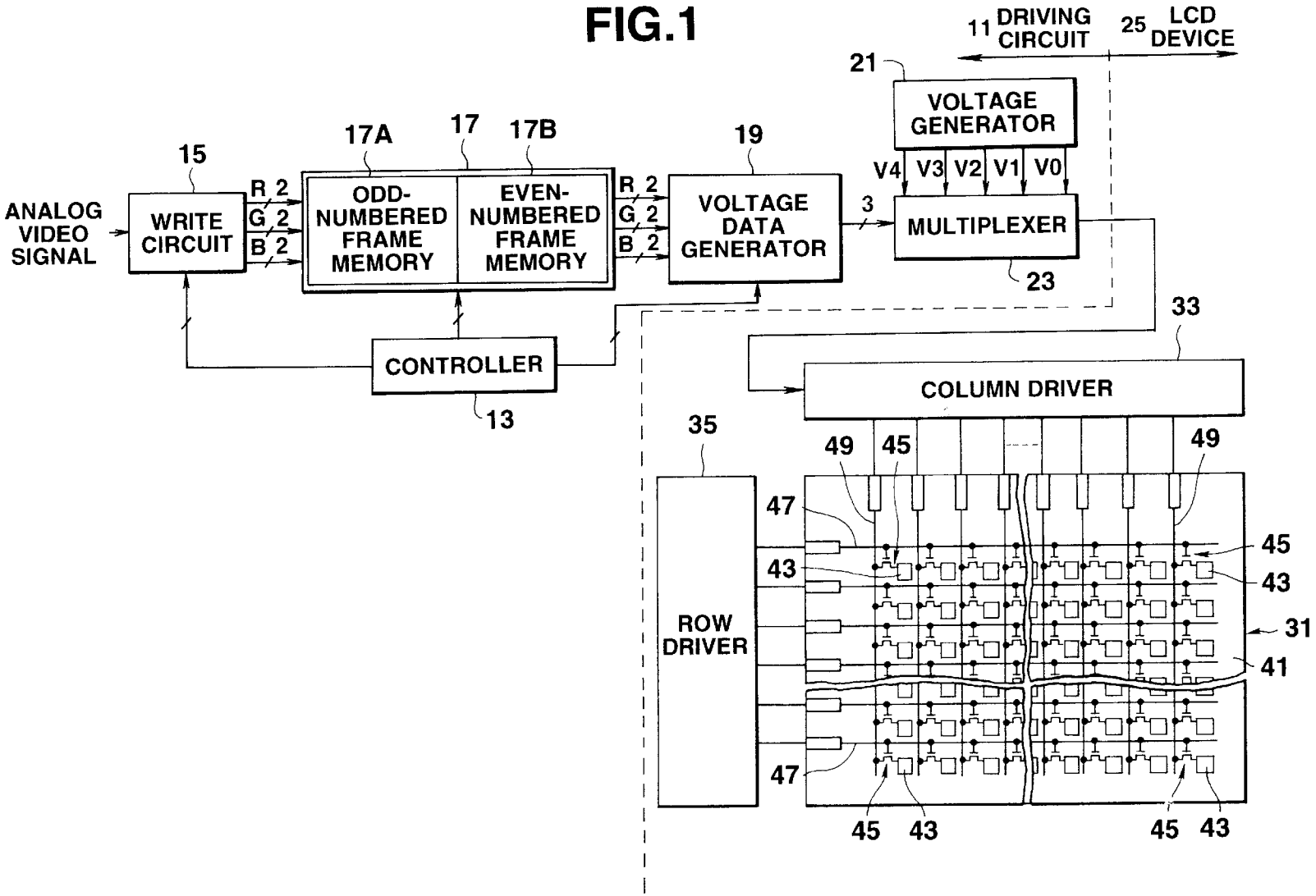
FIG. 1 is a circuit diagram of an LCD apparatus according to a first embodiment of this invention.

As shown in FIG. 1, this LCD apparatus comprises a driving circuit 11 and an LCD device 25. The LCD device 25 includes a birefringence control type active matrix LCD panel 31, a column driver 33 and a row driver 35. The LCD panel has a pair of transparent substrates 41 and 51.

Figure 2:
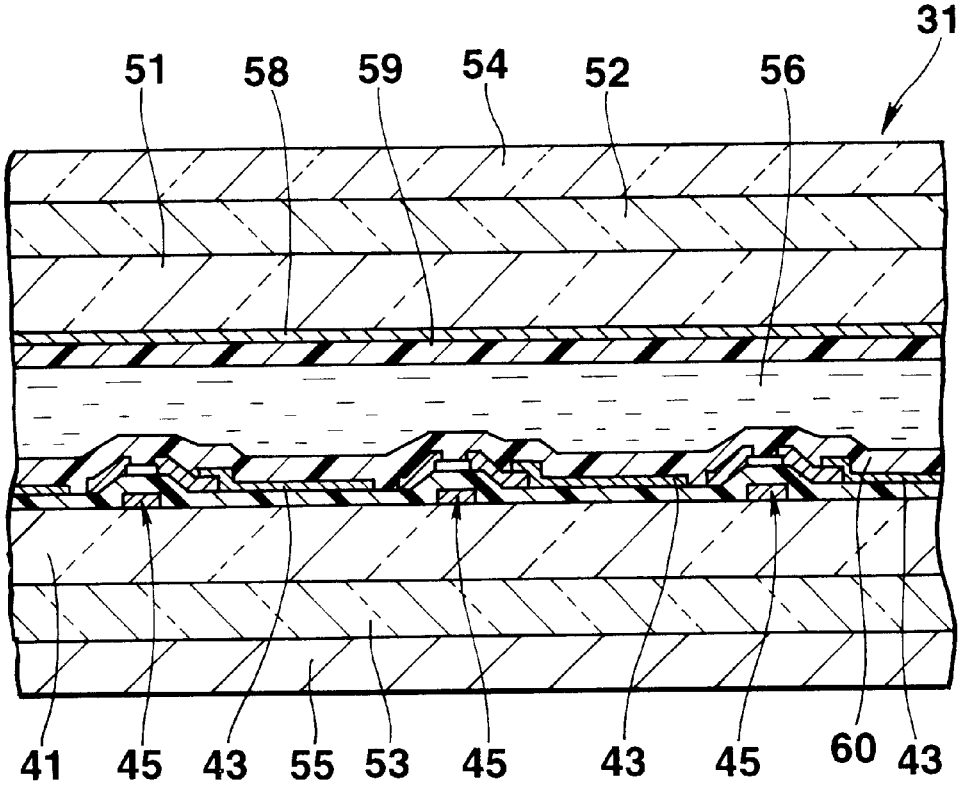
FIG. 2 is a cross-sectional view of an LCD panel.
Figure 3:
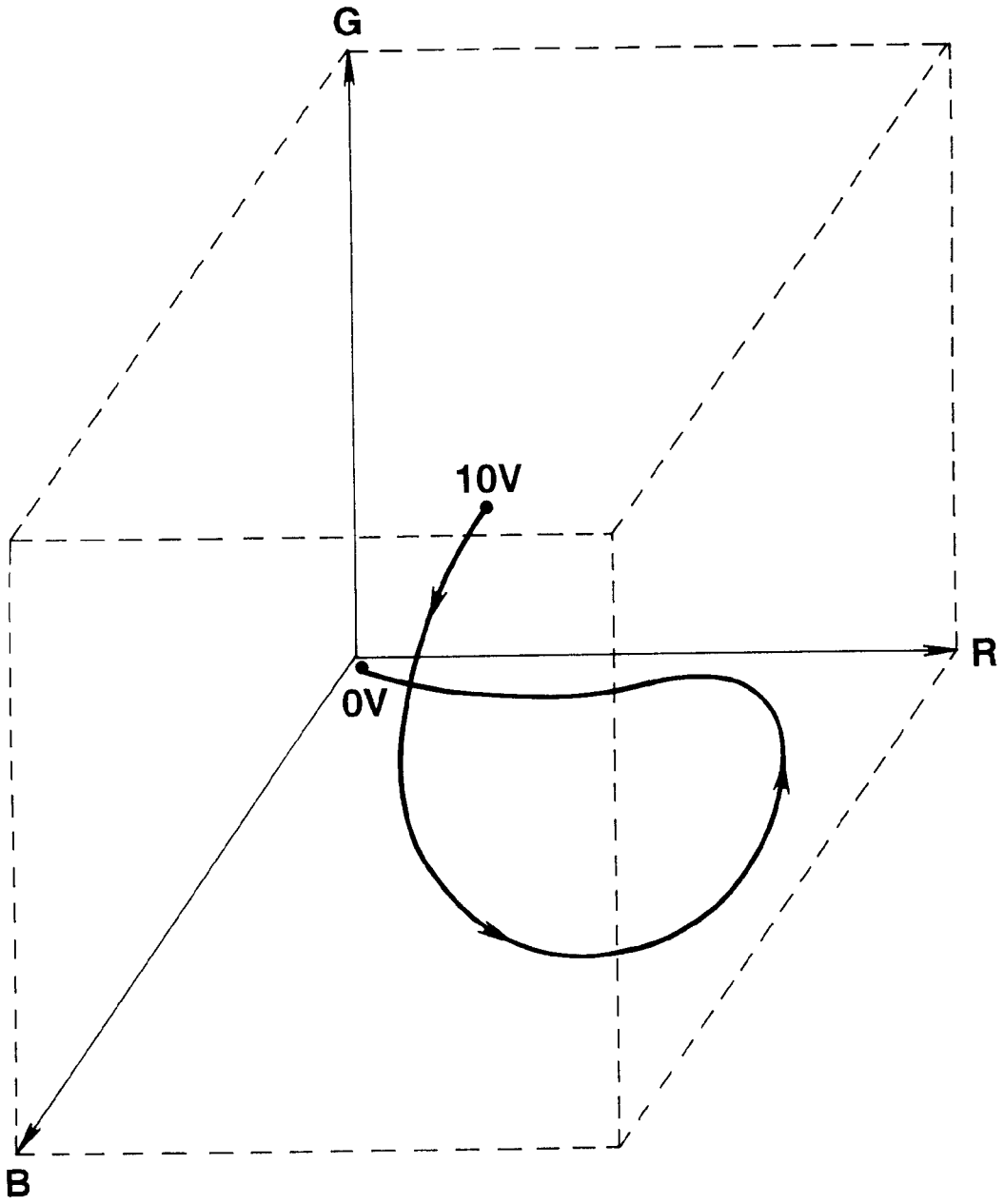
FIG. 3 is an RBG chromaticity diagram showing the relationship between applied voltages and display colors.
Figure 4:
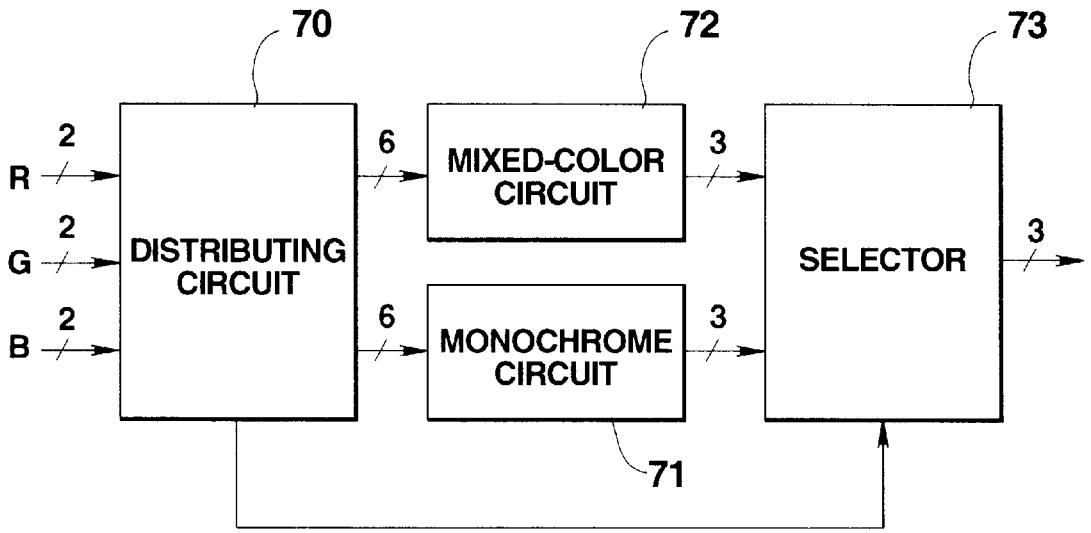
FIG. 4 is a circuit diagram showing the circuit structure of a voltage data generator shown in FIG. 1.

As shown in FIGS. 2 and 3, pixel electrodes 43 and TFTs 45 having sources connected to the pixel electrodes 43 are arranged in a matrix form on a lower substrate 41.

Gate lines (scan lines) 47 are formed in a row direction on the lower substrate 41, each gate line 47 connected to the gate electrodes of the associated row of TFTs 45, as shown in FIG. 1. Data lines (color signal lines) 49 are formed in a column direction, each data line 49 connected to the drains of the associated column of TFTs 45.

As shown in FIG. 2, an alignment film 60, having undergone an aligning treatment, is provided on the pixel electrodes 43 and the TFTs 45. A polarization plate 53 is provided at the back of the lower substrate 41, and a reflector 55 made of metal, such as aluminum, is provided at the back of the polarization plate 53.

As shown in FIG. 2, a transparent opposing electrode 58 opposing the individual pixel electrodes 43 is formed on the surface of the upper substrate 51 which faces the lower substrate 41. An alignment film 59, having undergone an aligning treatment, is provided on the opposing electrode 58. A retardation plate 52 is provided on the top surface of the upper substrate 51, and a polarization plate 54 is provided on the top surface of this retardation plate 52.

Both substrates 41 and 51 are adhered via a frame-shaped seal member (not shown). A liquid crystal 56, which is, for example, a nematic liquid crystal having the positive dielectric anisotropy, is sealed in the area surrounded by both substrates 41 and 51, in a state twisted by the alignment films 59 and 60.

The alignment direction of the LC molecules in the vicinity of the alignment film 59 on the upper substrate 51 is shifted about 90 degrees counterclockwise, for example, as viewed from the top or from an observing side with respect to the alignment direction of the LC molecules in the vicinity of the alignment film 60 on the lower substrate 41 (azimuth angle of 0 degree). The LC molecules of the liquid crystal 56 are therefore twisted at an angle of approximately 90 degrees between both substrates 41 and 51.

The transmission axis of the upper polarization plate 54 extends in the direction of 30 degrees with respect to the azimuth of 0 degree as viewed from the observing side. The transmission axis of the lower polarization plate 53 extends in the direction of 50 degrees with respect to the azimuth angle of 0 degree as viewed from the observing side. The phase delay axis of the retardation plate 52 is inclined to the transmission axis of the upper polarization plate 54.

The incident light to the LCD panel 31 passes the upper polarization plate 54, the retardation plate 52, the liquid crystal 56 and the lower polarization plate 53 in order, and is then reflected at the reflector 55. The reflected light sequentially passes the lower polarization plate 53, the liquid crystal 56, the retardation plate 52 and the upper polarization plate 54 and then leaves the LCD panel 31.

The light linearly polarized when passing the upper polarization plate 54 becomes elliptically polarized light whose light components of individual wavelengths have different polarized states due to the birifringence effect while passing the retardation plate 52. This elliptically polarized light changes its polarized state by the birefringence effect while passing the liquid crystal 56, and then hits the lower polarization plate 53. Of the individual incident wavelength-component lights, only the polarized light component in the direction of the transmission axis of the lower polarization plate 53 passes the lower polarization plate 53, and is reflected at the reflector 55.

The polarized state of this reflected light is changed again by the birefringence effect while sequentially passing the lower polarization plate 53, the liquid crystal 56 and the retardation plate 52, and the light then hits the upper polarization plate 54. Of the light incident to the upper polarization plate 54, only the polarized component in the direction of the transmission axis of the polarization plate 54 passes the polarization plate 54, and the light is colored according to the wavelength of the transmitted light. The birefringence of the liquid crystal 56 changes in accordance with the electric field (voltage) applied to the liquid crystal 56, and the spectrum distribution of the light leaving the upper polarization plate 54 changes in accordance with a variation in birefringence. The color of the light leaving the LCD panel 31 therefore varies in accordance with the voltage applied to the liquid crystal 56.

The column driver 33 (FIG. 1) has a sample and hold circuit to sample signals supplied from the driving circuit 11 (write voltages V0 to V4 to be discussed later). After sampling one scan line of signals, the column driver 33 supplies each sampled signal to the associated data line 49.

The row driver 35 sequentially applies a gate pulse to the gate lines 47. The TFTs 45 connected to the gate line 47 to which the gate pulse is applied are turned on. The voltage on the data line 49 is applied to the pixel electrodes 43 connected to the activated TFTs 45.

The row driver 35 disables the gate pulse immediately before the write voltage applied to the data line 49 is switched. Then, the TFTs 45 are turned off, and the voltages, which have been applied to that point, are held in the pixel capacitors formed by the pixel electrodes 43, the opposing electrode 51 and the liquid crystal 56 lying between both electrodes 43 and 51. During the non-selection period, therefore, the alignment states of the LC molecules is kept at the desired state to keep the desired display colors.

The relationship between applied voltages and display colors may be expressed by the characteristic curve shown in FIG. 3. The colors on the characteristic curve can all be displayed by controlling the applied voltages. Actually, however, colors may change due to a variation in the supply voltage caused by the narrow voltage ranges which can provide the colors, or the display colors may change due to a temperature change. In view of such a problem, the voltages to be applied to the liquid crystal 56 are limited only to voltages V0, V1, V2, V3 and V4 which can stably display the basic colors red, green, blue, black and white in this embodiment. The other colors than those basic colors are provided by displaying the basic colors over a plurality of display frames and mixing (visually mixing) the displayed colors.

To ensure such mixed-color display, the driving circuit 11 comprises a controller 13, a write circuit 15, a frame memory 17, a voltage data generator 19, a voltage generator 21 and a multiplexer 23.

The write circuit 15, which includes an Y/C separator and an A/D converter, converts an analog TV signal of the NTSC system into RGB luminance data (image data) consisting of two bits for each of R, G and B, indicative of the luminance of each pixel, and outputs the luminance data. The frame memory 17 has a memory 17A for odd-numbered frames and a memory 17B for even-numbered frames, each having the capacity for storing one frame of luminance data. The memory 17A and the memory 17B alternately store one frame of RGB luminance data output from the write circuit 15.

The voltage data generator 19 has a distributing circuit 70, a monochrome circuit 71, a mixed-color circuit 72 and a selector 73.

The distributing circuit 70 determines whether the color specified by the RGB luminance data (total of six bits) supplied from the frame memory 17 is directly displayable by the application of the voltages V0–V4 or is to be expressed by mixed colors. When the color specified by the RGB luminance data (total of six bits) supplied from the frame memory 17 is directly displayable, the distributing circuit 70 supplies the received RGB luminance data to the monochrome circuit 71. When the specified color should be expressed by a mixed color, the distributing circuit 70 supplies the received RGB luminance data to the mixed-color circuit 72.

When the RGB luminance data specifies any basic color which can be displayed by the application of any of the voltages V0–V4, the monochrome circuit 71 outputs voltage data which indicates the selection of the associated one of those five voltages. The monochrome circuit 71 is constituted of a monochromatic conversion table 81. As shown in FIG. 6, for example, this table 81 stores voltage data indicating voltages to be selected at the address positions having the values of RGB luminance data which indicate the basic colors.

Figure 7:
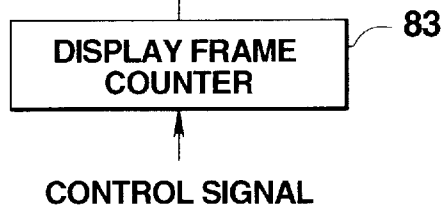
FIG. 7 is a diagram exemplifying the structure of a mixed-color conversion table.

When the RGB luminance data specifies a color which is to be displayed by color mixture, the mixed-color circuit 72 sequentially outputs voltage data indicating voltages to be applied to the associated pixel to three display frames. The mixed-color circuit 72 has a mixed-color conversion table 82 and a display frame counter 83, as shown in FIG. 7. This table 82 stores voltage data indicating voltages to be selected for the individual display frames at the address positions having the values of RGB luminance data. The frame counter 83, which is a ternary counter, indicates which display frame in one frame of a video signal the current display frame is.

The selector 73 selects either the output of the monochrome circuit 71 or the output of the mixed-color circuit 72 in accordance with the signal from the distributing circuit 70, and outputs the selected output to the multiplexer 23.

The voltage generator 21 includes a voltage dividing circuit and generates the predetermined five types of write voltages V0–V4. The multiplexer 23 selects one of the five write voltages V0–V4, produced by the voltage generator 21, in accordance with the output of the voltage data generator 19, and supplies the selected voltage to the column driver 33 of the LCD device 25.

The controller 13 controls the write circuit 15 to write the RGB luminance data of an odd-numbered frame of the video signal into the odd-numbered frame memory 17A and to write the RGB luminance data of an even-numbered frame of the video signal into the even-numbered frame memory 17B. Further, the controller 13 sequentially reads RGB luminance data from the even-numbered frame memory 17B and supplies it to an odd-numbered frame of the video signal, and sequentially reads the RGB luminance data from the odd-numbered frame memory 17A and supplies it to an even-numbered frame of the video signal. As mentioned above, the frame frequency of an image to be displayed is three times as high as the frame frequency of a video signal. The reading speed is therefore approximately three times faster than the writing speed. The controller 13 controls the count value of the display frame counter 83.

The mixed-color conversion table 82 may be set as follows.

First, the characteristic of the birefringence control type LCD device 25 in use (the characteristic indicating a change in the display color with respect to the applied voltage) may be obtained as shown in FIG. 3. Next, five basic colors which can be displayed stably and the write voltages V0–V4 necessary to display those basic colors are obtained. Then, with regard to 59 colors excluding the basic colors among 64 ($2^2 \times 2 \times 2^2$) colors defined by RGB data consisting of a total of six bits, two bits for each of R, G and B data, the basic colors to be mixed to approximate the 59 colors are obtained. Then, voltage data corresponding to the selected basic colors are set in an arbitrary order into the mixed-color conversion table 82.

The operation of the thus constituted LCD apparatus will be described below.

The write circuit 15 converts an externally supplied video signal into R, G and B luminance data each consisting of two bits and stores the data in the memory 17A or 17B under the control of the controller 13.

The controller 13 reads the RGB luminance data from one of the memories 17A and 17B, pixel by pixel (six bits each), at the frame frequency three times higher than that of the video signal, and sequentially supplies the data to the voltage data generator 19. When the RGB luminance data indicates red, green, blue, black or white, i.e., any basic color, the distributing circuit 70 in the voltage data generator 19 sends the supplied RGB luminance data to the monochrome circuit 71. The monochrome circuit 71 outputs voltage data corresponding to the supplied RGB luminance data.

When the RGB luminance data indicates a color other than the basic colors, the distributing circuit 70 in the voltage data generator 19 sends the supplied RGB luminance data to the mixed-color circuit 72. The display frame counter counts the display frame number in one video frame in accordance with the control signal from the controller 13. The mixed-color conversion table 82 outputs voltage data, which corresponds to the supplied RGB luminance data and the display frame number indicated by the display frame counter 83.

The selector 73 selects the voltage data output from the monochrome circuit 71 or the mixed-color circuit 72 in accordance with the control signal from the distributing circuit 70, and outputs the selected output to the multiplexer 23. In accordance with the supplied voltage data, the multiplexer 23 selects one of the write voltages V0–V4 output from the voltage generator 21, and supplies the selected voltage to the column driver 33.

After sampling one scan line of signals, the column driver 33 supplies each sampled write voltage to the associated data line 49.

The row driver 35 sequentially applies a gate pulse to the gate lines 47 to enable the associated TFTs 45, and applies the voltages corresponding to the display colors to the pixel electrodes 43 via the activated TFTs 45 from the data line 49.

When the gate pulse is disabled, the TFTs 45 are turned off, and the applied write voltages are held in the pixel capacitors formed by the pixel electrodes 43, the opposing electrode 51 and the liquid crystal 56 lying between both electrodes 43 and 51. During the non-selection period, therefore, the alignment states of the LC molecules is kept at the desired state and the desired birefringence property is maintained to thereby keep the desired display colors.

By repeating the above operation, the colors defined by the RGB luminance data stored in the frame memory 17 are displayed in the form of the mixed colors of three frames of display colors for each pixel.

Figures 5A, 5B, 5C:
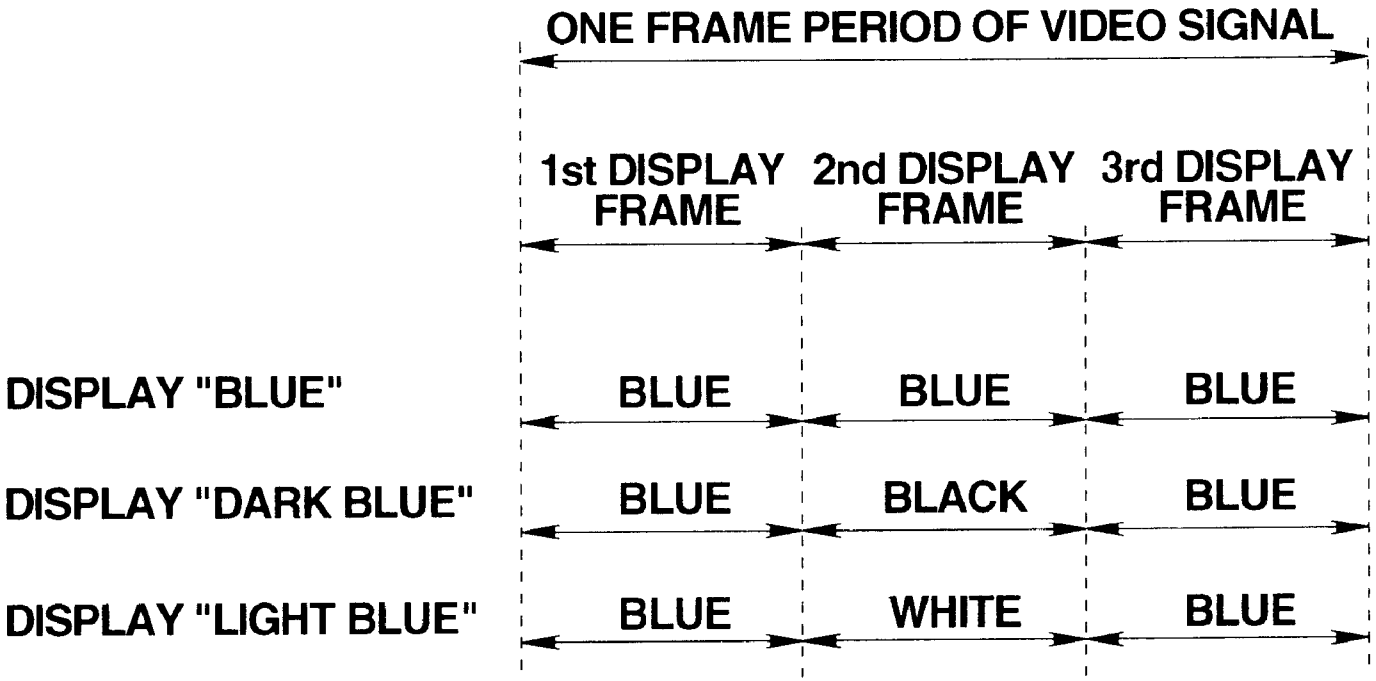
FIGS. 5A to 5C are diagrams showing the relationship between one frame of a video signal and a display frame and exemplifying colors the LCD panel displays on three display frames in one frame of a video signal.

When the video signal indicates "blue" (000010) as the display color of one pixel, for example, the voltage data generator 19 outputs voltage data "010" to the first to third display frames in accordance with the contents of the monochrome conversion table 81 shown in FIG. 6. In accordance with this voltage data, the multiplexer 23 outputs the write voltage "V2" to the first to third display frames. As shown in FIG. 5A, therefore, "blue" is displayed in every one of the first to third display frames so that blue is displayed for the entire three display frames.

When the video signal indicates "dark blue" (000001) as the display color of one pixel, the voltage data generator 19 outputs voltage data "010" to the first to third display frames and voltage data "011" to the second display frame, in accordance with the contents of the mixed-color conversion table 82 shown in FIG. 7. Accordingly, the multiplexer 23 outputs the write voltage "V2" to the first and third display frames and outputs the write voltage "V3" to the second display frame. Those voltages are applied to the associated display frames of the associated pixel and "blue"→"black"→"blue" are displayed in this order as shown in FIG. 5B. Those display colors are visually combined by an observer and are recognized as "dark blue" by the observer.

When the video signal indicates "light blue" (000011), the voltage data generator 19 outputs voltage data "010," "100" and "010" to the first to third display frames, respectively, in accordance with the contents of the mixed-color conversion table 82 shown in FIG. 7. As a result, the multiplexer 23 outputs the write voltage "V2" to the first and third display frames and outputs the write voltage "V4" to the second display frame. Those voltages are applied to the associated display frames of the associated pixel and "blue"→"white"→"blue" are displayed in this order as shown in FIG. 5C. Those display colors are visually combined by an observer and are recognized as "light blue" by the observer.

According to this embodiment, as described above, a birefringence control type LCD device in which the frequency of the display frame is higher than the frame frequency of a video signal is used, the number of colors to be actually displayed is limited to five, and an arbitrary color is displayed by mixing those five colors. It is therefore possible to display colors which cannot be displayed stably, or display colors which cannot be displayed in view of the applied voltages v.s. display colors characteristic. It is also possible to suppress the number of write voltages for the displayable colors.

Although the voltage data generator 19 in this embodiment uses the monochrome conversion table and mixed-color conversion table to convert RGB luminance data to voltage data, RGB luminance data may be converted to voltage data using another scheme. For instance, the same voltage data may be stored at the areas for the first to third display frames in the mixed-color conversion table 82 so that the mixed-color conversion table 82 can also be used in displaying primary colors. This modification can eliminate the distributing circuit 70, the monochrome circuit 71 and the selector 73.

Second Embodiment

According to the LCD apparatus according to the first embodiment, the displayable colors depend on the combinations of the applied voltages so that thee may be a difference between the desired color and the actually displayed color. A description will be given of an LCD apparatus which can reduce the difference between the desired color and the actually displayed color a method of driving an LCD device.

Figure 8:
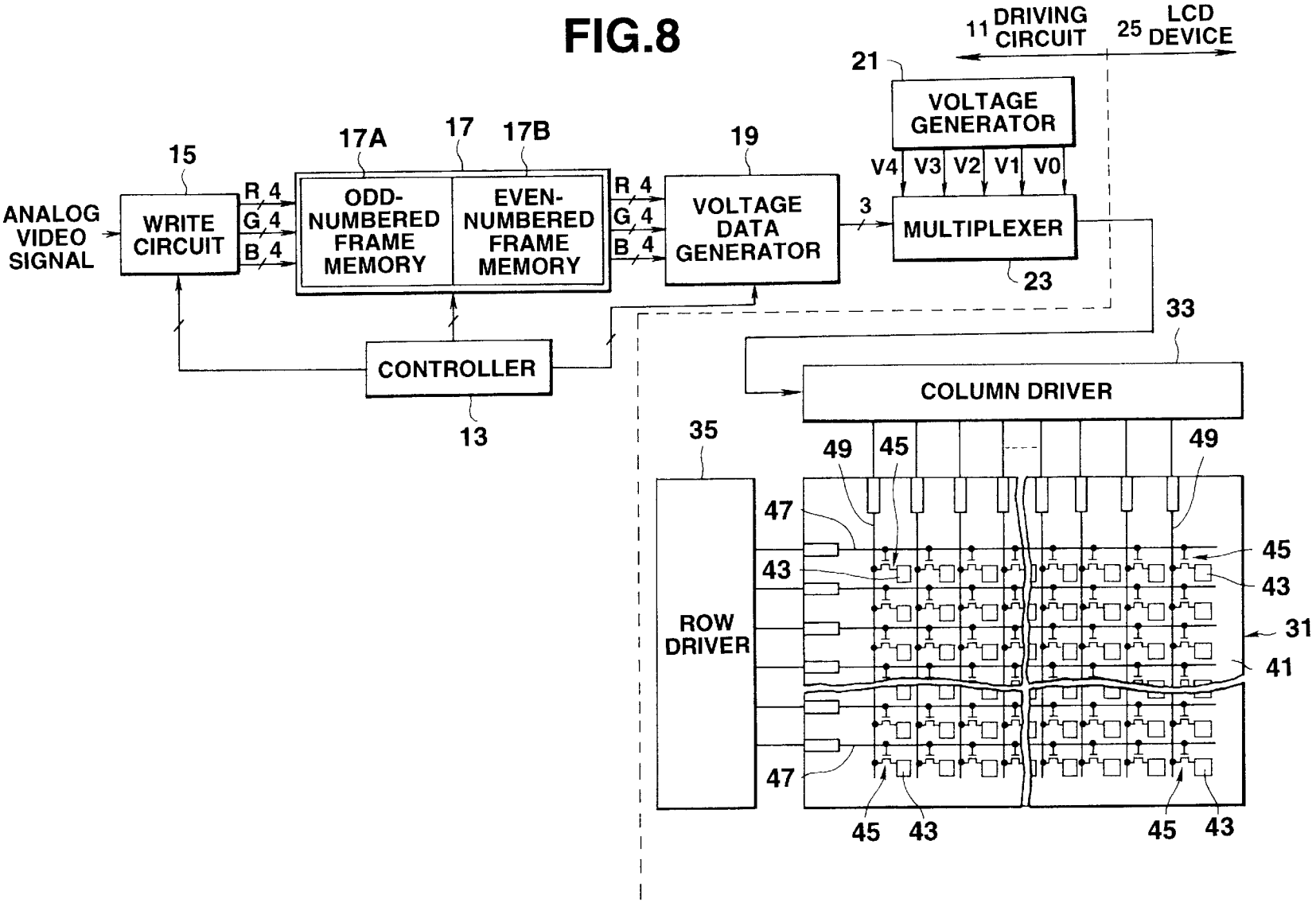
FIG. 8 is a circuit diagram of an LCD apparatus according to a second embodiment of this invention.

As shown in FIG. 8, this LCD apparatus like the first embodiment comprises the driving circuit 11 and LCD device 25.

The driving circuit 11 and LCD device have substantially the same basic structures as those of the first embodiment with the difference that RGB luminance data consists of four bits.

Figure 9:
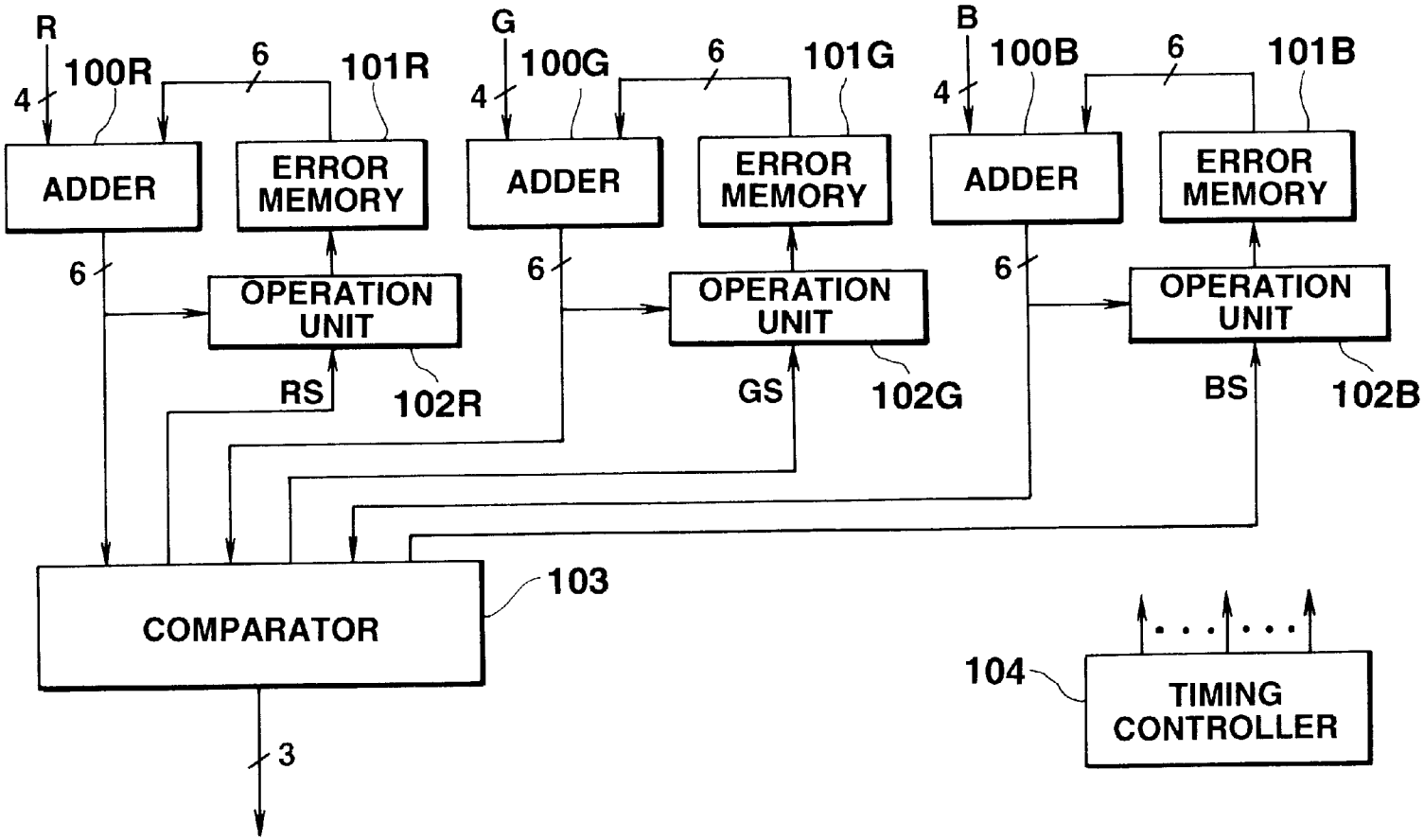
FIG. 9 is a circuit diagram showing the circuit structure of a voltage data generator shown in FIG. 8.

The voltage data generator 19 comprises adders 100R, 100G and 100B, error memories 101R, 101G and 100B, operation units 102R, 102G and 102B, all arranged in association with RGB data, a comparator 103 and a timing controller 104, as shown in FIG. 9.

The error memories 101R, 101G and 101B respectively store R, G and B error data each of six bits for each pixel.

The adders 100R, 100G and 100B adds R, G and B luminance each of four bits and the associated error data respectively stored in the error memories 101R, 101G and 101B and output 6-bit added values to the comparator 103.

A predetermined value "010000" (binary notation), which is about 40% to 80% of the maximum value of the RGB luminance data, is set in the comparator 103. The comparator 103 compares the 6-bit added values from the adders 100R, 100G and 100B with the predetermined value "010000" and outputs voltage data indicating the selection of the write voltage that displays colors whose added values are equal to or greater than the predetermined value. When there are a plurality of added values equal to or greater than the predetermined value, the comparator 103 outputs voltage data for selecting the write voltage that displays a color having the maximum value. When there are same added values equal to or greater than the predetermined value, the comparator 103 outputs voltage data for selecting the write voltage in the priority order of R, G and B. When there no added values equal to or greater than the predetermined value, the comparator 103 outputs voltage data for selecting the write voltage that displays black. When all the added values of the R, G and B luminance data are equal to or greater than the predetermined value, the comparator 103 outputs voltage data for selecting the write voltage that displays white.

The predetermined value should be set large to make the display of the basic colors R, G and B clearer, and should be set small to improve the display of mixed colors of R, G and B. The predetermined value can be set as desired in accordance with the characteristics of the LCD device.

Further, the comparator 103 outputs a select signal RS, GS or BS to the respective operation unit 102R, 102G or 102B associated with the selected color. When receiving the select signals RS, GS and BS, the operation units 102R, 102G and 102B subtract the predetermined value "010000" from the added values from the associated adders 100R, 100G and 100B and store the resultant values as error data into the associated error memories 101R, 101G and 101B. When receiving no select signals RS, GS and BS, the operation units 102R, 102G and 102B store the added values from the associated adders 100R, 100G and 100B as error data into the associated error memories 101R, 101G and 101B.

The timing controller 104 controls the operation timings of the above-described individual sections.

The operation of the LCD apparatus according to the second embodiment will be described below with reference to FIGS. 8 through 10.

The write circuit 15 converts an externally supplied video signal into R, G and B luminance data each consisting of four bits, stores the RGB luminance data for an odd-numbered frame of a video signal in the odd-numbered frame memory 17A and stores the RGB luminance data for an even-numbered frame of a video signal in the even-numbered frame memory 17B all under the control of the controller 13.

The controller 13 reads the RGB luminance data from the odd-numbered frame memory 17A in the odd-numbered frame period of the video signal or from the even-numbered frame memory 17B in the even-numbered frame period of the video signal pixel by pixel (12 bits each) at the frame frequency three times higher than that of the video signal, and sequentially supplies the data to the voltage data generator 19.

The voltage data generator 19 generates voltage data based on the supplied RGB luminance data and the difference between the old supplied RGB luminance data and the actually displayed color.

In accordance with the voltage data supplied from the voltage data generator 19, the multiplexer 23 selects one of the write voltages V0–V4 output from the voltage generator 21 and supplies the selected voltage to the column driver 33.

After sampling one scan line of signals, the column driver 33 supplies each sampled write voltage to the associated data line 49. The row driver 35 sequentially applies a gate pulse to the gate lines 47 to enable the associated TFTs 45, and applies the write voltages corresponding to the display colors to the selected row of pixel electrodes 43 via the activated TFTs 45 from the data line 49.

When the gate pulse is disabled, the TFTs 45 are turned off, and the write voltages are held in the pixel capacitors formed by the pixel electrodes 43, the opposing electrode 51 and the liquid crystal 56 lying between both electrodes 43 and 51. During the non-selection period, therefore, the alignment states of the LC molecules is kept at the desired state and the desired birefringence property is maintained to thereby keep the desired display colors.

Figures 10A, 10B, 10C, 10D, 10E:
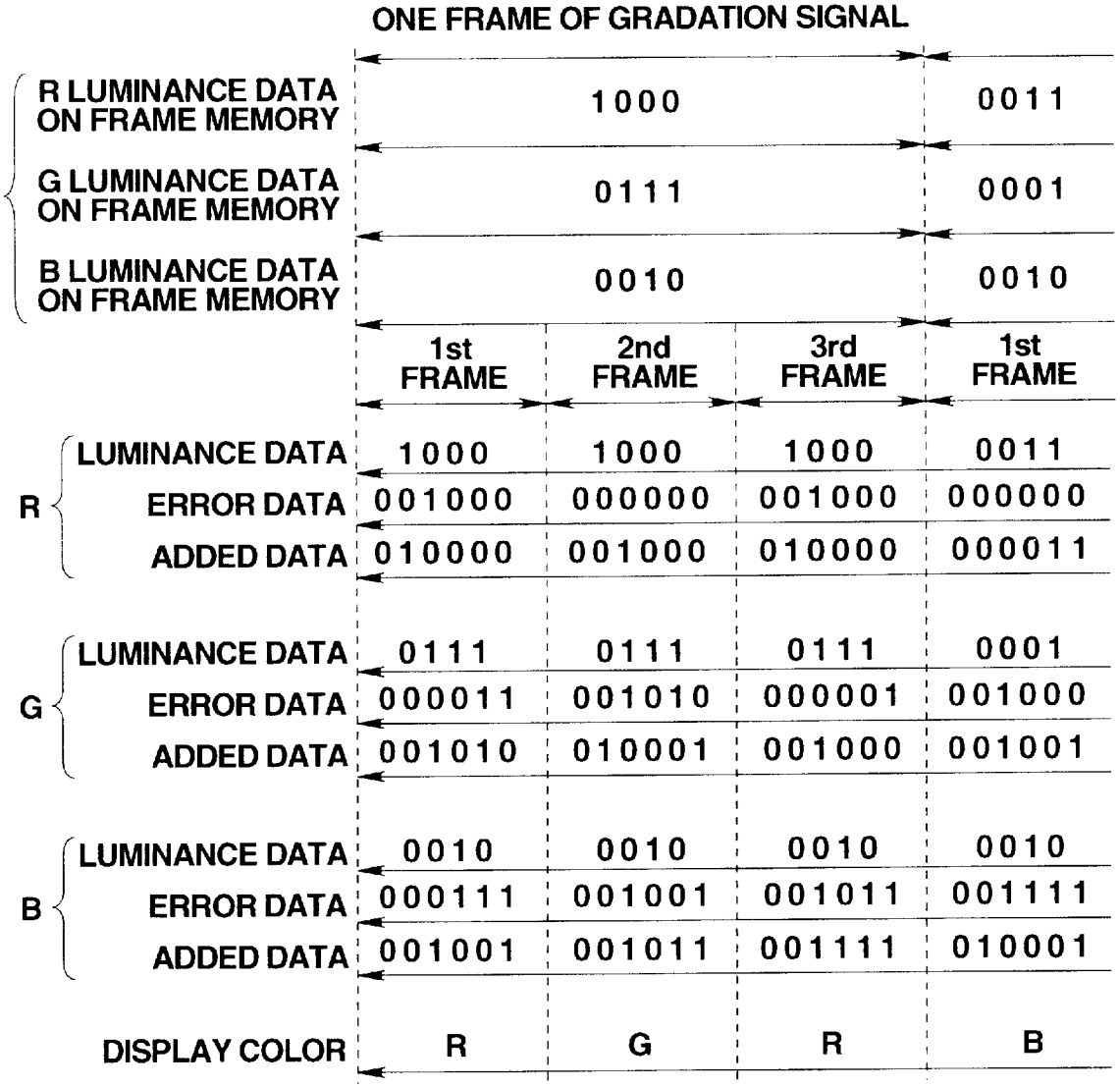
FIGS. 10A through 10E are diagrams showing the relationship between one frame of a video signal and a display frame and exemplifying colors the LCD panel displays on three display frames in one frame of a video signal.

A specific example of the above-described operation will now be explained. Let us consider the case where R, G and B luminance data for pixels stored in the frame memory 17 are "1000," "0111" and "0010" respectively for the first frame of a gradation signal and "0011," "0001" and "0010" respectively for the second frame of the gradation signal as shown in FIG. 10A. It is also assumed that the R, G and B error data stored in the respective error memories 101R, 101G and 101B are "001000," "000011" and "000111" as shown in FIGS. 10B to 10D.

In this case, the added values (added data) output from the adders 100R, 100G and 100B respectively become "010000," "001010" and "001001" for the first display frame in the first frame of a gradation signal as shown in FIGS. 10B to 10D, and the added value for R is equal to or greater than the predetermined value "010000." As a result, the comparator 103 outputs voltage data for displaying red and sends the select signal RS to the operation unit 102R associated with the selected red. In accordance with the select signal RS, the operation unit 102R subtracts the predetermined value "010000" from the added value "010000" output from the adder 100R and stores "000000" as error data in the error memory 101R, as shown in FIG. 10B. The operation units 102G and 102B which have not received the respective select signals GS and BS store the added values output from the respective adders 100G and 100B as error data into the error memories 101G and 101R as shown in FIGS. 10C and 10D.

In accordance with the voltage data supplied from the voltage data generator 19, the multiplexer 23 selects the write voltage V0 from the voltage generator 21 corresponding to the display of red and supplies it to the column driver 33. Consequently, the associated pixel of the LCD panel 31 displays red as shown in FIG. 10E.

For the second display frame, RGB luminance data "1000," "0111" and "0010" are read from the frame memory 17 also for that pixel as shown in FIGS. 10B to 10D. The read RGB luminance data are added to the error data "000000," "001010" and "001001" obtained for the first display frame and the added values become "001000," "010001" and "001011."

The added value for G becomes equal to or greater than the predetermined value "010000" so that the comparator 103 outputs voltage data for displaying green. In accordance with the supplied voltage data, the multiplexer 23 selects the write voltage V1 and supplies it to the column driver 33. Consequently, the associated pixel of the LCD panel 31 displays green as shown in FIG. 10E.

The operation unit 102G having received the select signal GS from the comparator 103 subtracts the predetermined value "010000" from the added value "010001" and stores "000001" as error data in the error memory 101R, and the operation units 102R and 102B store the added values "001000" and "001011" as error data into the error memories 101R and 101B, respectively.

In the third display frame, as shown in FIGS. 10B to 10D, the RGB luminance data "1000," "0111" and "0010" are read again and respectively added to the error data "001000," "000001" and "001011," yielding added values "010000," "001000" and "001111."

The added value for R becomes equal to or greater than the predetermined value "010000" so that the comparator 103 outputs voltage data for displaying red. In accordance with the supplied voltage data, the multiplexer 23 selects the write voltage V0 and supplies it to the column driver 33. Consequently, the associated pixel of the LCD panel 31 displays red as shown in FIG. 10E.

As shown in FIGS. 10B to 10D, the operation unit 102R stores the added value "010000–010000" as error data in the error memory 101R, and the operation units 102G and 102B store the added values "001000" and "001111" as error data into the error memories 101G and 101B, respectively.

Likewise, for the first display frame in the second frame of the gradation signal, the comparator 103 outputs voltage data for displaying blue. In accordance with the supplied voltage data, the multiplexer 23 selects the write voltage V2 and supplies it to the column driver 33. Consequently, the associated pixel of the LCD panel 31 displays blue as shown in FIG. 10E.

By repeating the above operations, the pixel of interest sequentially displays "R," "G," "R" and "B" in the individual display frames. In this manner, the color defined by the RGB luminance data stored in the frame memory 17 is displayed as the mixed color of the display colors for three display frames for each pixel. Further, error data indicating the difference between a video signal and the actually displayed color is distributed to the next display frame and is added to the luminance data of that display frame, and the resultant data is reflected in the display image. It is therefore possible to reduce the difference between the image defined by the video signal and the actually displayed image.

When there are a plurality of added values equal to or greater than the predetermined value, the comparator 103 outputs voltage data for selecting the write voltage which displays a color having the maximum value.

When the output value of the adder 100R is "010011," the output value of the adder 100G is "011111" and the output value of the adder 100B is "000011," for example, the comparator 103 outputs voltage data for displaying green corresponding to the maximum value "011111" and sends the select signal GS to the operation unit 102G. The operation units 102R, 102G and 102B store error data "010011," "001111" and "000011" into the respective error memories 101R, 101G and 101B.

When there are same added values equal to or greater than the predetermined value, the comparator 103 outputs voltage data for selecting the write voltage in the priority order of R, G and B.

When the output value of the adder 100R is "010011," the output value of the adder 100G is "010011" and the output value of the adder 100B is "000011," for example, the comparator 103 outputs voltage data for displaying red by the priority and sends the select signal RS to the operation unit 102R. The operation units 102R, 102G and 102B cause the error memories 101R, 101G and 101B to store error data "000011," "010011" and "000011," respectively.

When there are no added values equal to or greater than the predetermined value, the comparator 103 outputs voltage data for selecting the write voltage which displays black.

When the output value of the adder 100R is "000011," the output value of the adder 100G is "000111" and the output value of the adder 100B is "001111," for example, the comparator 103 outputs voltage data for displaying black and sends no select signal. The operation units 102R, 102G and 102B cause error data "000011," "000111" and "001111" into the respective error memories 101R, 101G and 101B, respectively.

When all the added values are equal to or greater than the predetermined value, the comparator 103 outputs voltage data for selecting the write voltage which displays white.

When the output value of the adder 100R is "010011," the output value of the adder 100G is "010111" and the output value of the adder 100B is "011111," for example, the comparator 103 outputs voltage data for displaying white and sends all the select signals RS, GS and BS. The operation units 102R, 102G and 102B cause error data "000011," "000111" and "001111" into the respective error memories 101R, 101G and 101B, respectively.

According to the second embodiment, as described above, when there is a difference between RGB luminance data up to the previous display frame and the actually displayed image, the difference is reflected as error data in the display. It is therefore possible to reduce the difference between the image specified by the video signal and the actually displayed image.

The frame period of video signals of the NTSC system is 60 Hz. It is therefore desirable that the display frames of the LCD devices according to the first and second embodiments have a response speed as fast as or faster than about 180 Hz. When the frames of video signals are thinned and an image is displayed at a speed of 30 Hz, the display frames of the LCD device should desirably have a display frequency of about 90 Hz. In displaying a still picture, it is desirable that an image should be displayed at the display frame frequency of 30 Hz or higher, desirably 60 Hz or higher, in order to prevent the colors of the individual display frames from being recognized separately which results in flickering.

Although one frame of a video signal is separated into three display frames according to the first and second embodiments, it may be separated into two display frames or four or more display frames.

Although the colors the LCD device 25 actually displays are "red," "green," "blue," "black" and "white" in the first and second embodiments, other colors, such as mixed colors of those colors, may be displayed.

For example, a voltage V5 for displaying yellow is produced by the voltage generator 21 and when the added values for R and G both become a second predetermined value "001000" smaller than the aforementioned predetermined value, the comparator 103 outputs voltage data for displaying yellow, the multiplexer 23 and the column driver 33 apply the voltage V5 to an associated pixel to display yellow. In this case, the values obtained by subtracting "001000" from the added values are set as new error data for R and G.

This will be described below more specifically. When the output value of the adder 100R is "010000," the output value of the adder 100G is "010111" and the output value of the adder 100B is "000011," for example, the comparator 103 outputs voltage data for displaying yellow and sends all second select signals RS2 and GS23. The operation unit 102R subtracts "001000" from the output value "010000" of the adder 100R, the operation unit 102G subtracts "001000" from the output value "010111" of the adder 100G, and the error memories 101R, 101G and 101B respectively store error data "010000," "001111" and "1000011."

The second predetermined value may be set equal to the predetermined value "010000."

Third Embodiment

The LCD apparatuses and driving methods of the first and second embodiments are effective when the response of the liquid crystal 56 is fast. When the response of the liquid crystal 56 is slow, the display color for each frame is not established and a series of display colors which are displayed during the transition of the alignment of the LC molecules are visually combined and the mixed color is recognized by the observer. Color display is therefore possible using such combined colors.

A description will now be given of the third embodiment which presents color display using colors obtained by combining a series of display colors which are displayed during the transition of the alignment of the LC molecules.

Figure 11:
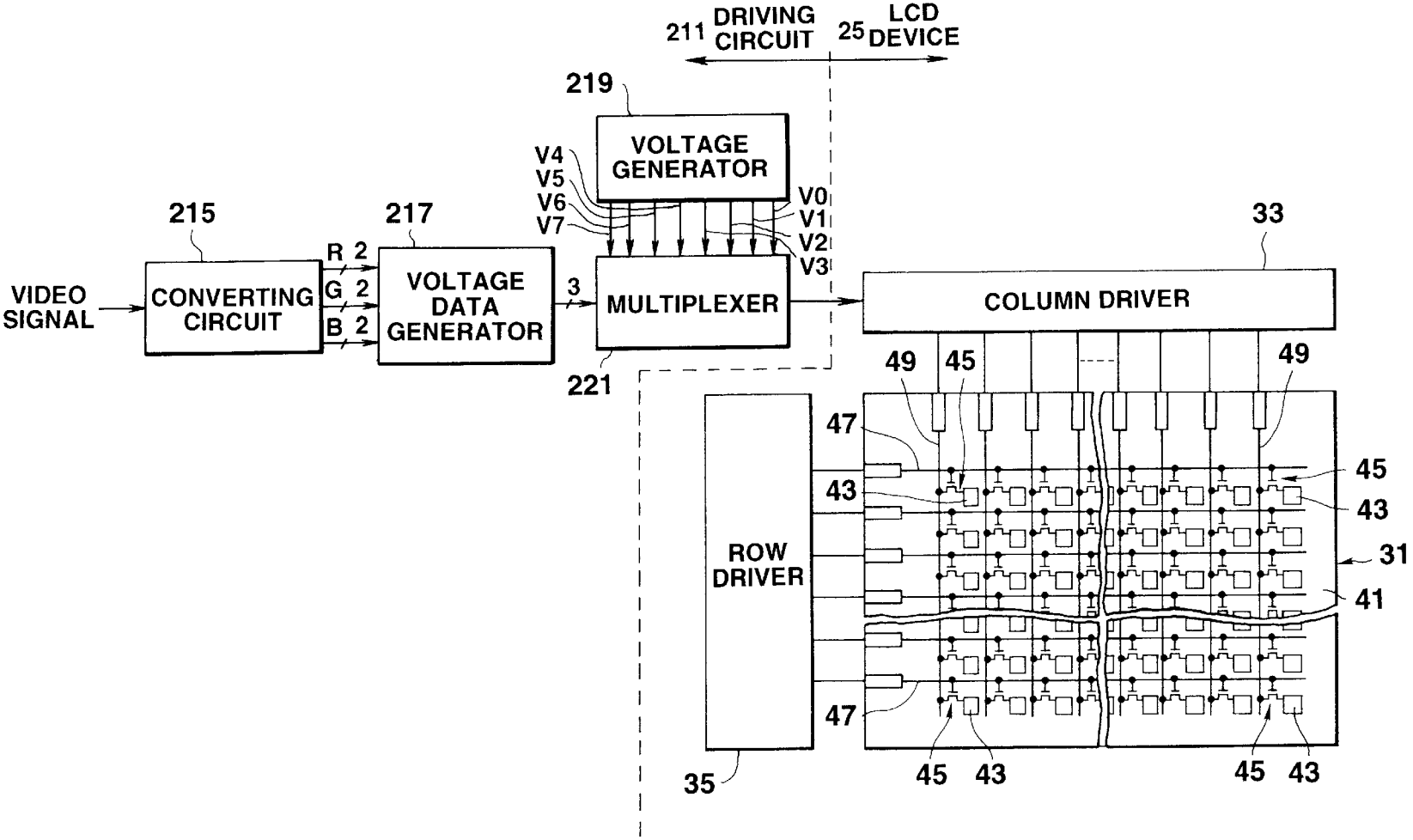
FIG. 11 is a circuit diagram of LCD apparatuses according to third and fourth embodiments of this invention.

As shown in FIG. 11, this LCD apparatus comprises a driving circuit 211 and LCD device 25.

The LCD device 25, like those of the first and second embodiments, comprises the birefringence control type active matrix LCD panel 31, column driver 33 and row driver 35. The LCD panel 31 basically has the same structure as the one shown in FIG. 2.

The driving circuit 211 includes a converting circuit 215, a voltage data generator 217, a voltage generator 219 and a multiplexer 221.

The converting circuit 215, which includes an Y/C separator and an A/D converter, converts an analog TV signal of the NTSC system into RGB luminance data (image data) consisting of two bits for each of R, G and B, indicative of the luminance of each pixel, and outputs the luminance data.

Figure 12:
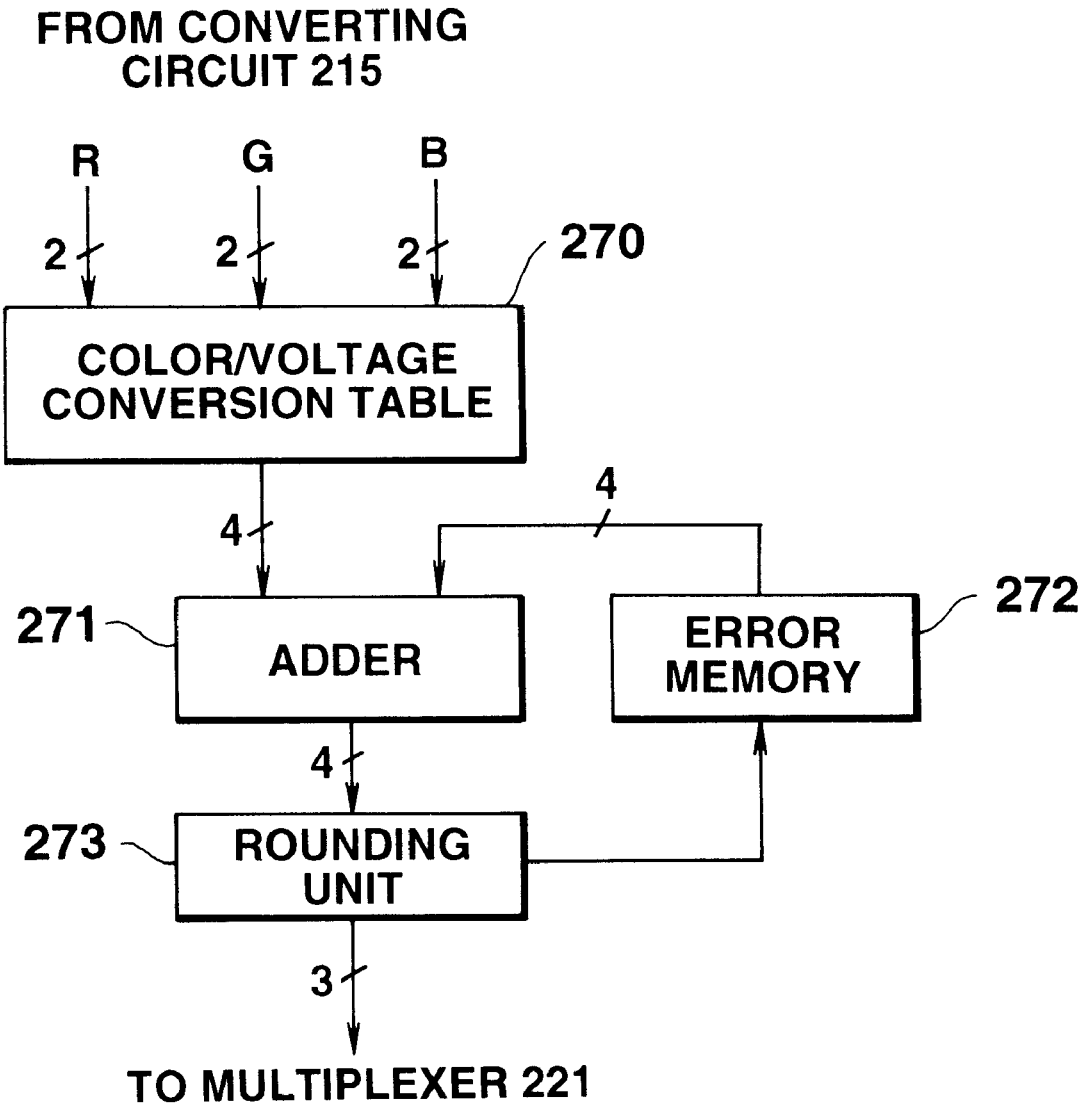
FIG. 12 is a circuit diagram showing the circuit structure of a voltage data generator shown in FIG. 11.
Figure 15:
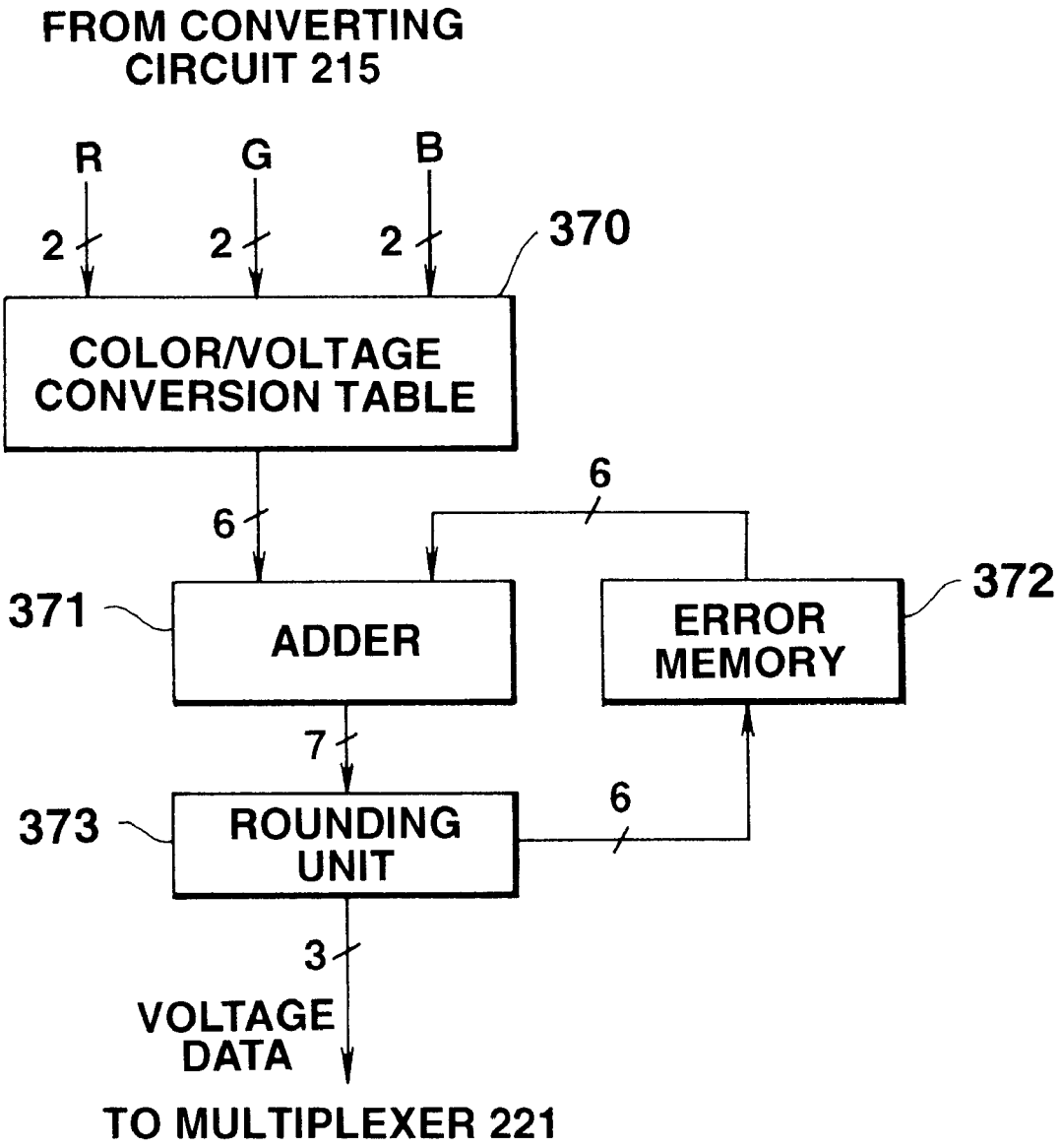
FIG. 15 is a circuit diagram showing the circuit structure of a voltage data generator of the forth embodiment.

The voltage data generator 217 comprises a color/voltage conversion table 270, an adder 217, an error memory 272 and a rounding unit 273, as shown in FIG. 12.

The color/voltage conversion table 270 stores voltage data consisting of, for example, four bits and indicative of a voltage to be applied to the liquid crystal to display the color which is defined by the RGB luminance data, at the address position indicated by a video signal consisting of two bits for each of R, G and B, as shown in FIG. 13. The upper three bits correspond to the write voltages V0 to V7 and indicate which one of the voltages V0–V7 should be selected, while the least significant bit indicates whether the same voltage should be applied continuously or different voltages should be applied alternately.

The adder 271 adds 4-bit voltage data, supplied from the color/voltage conversion table 270, and the 4-bit error data read from the error memory 272. The error memory 272 has a capacity for storing one frame of error data, and stores the difference or error between the voltage to be applied to each pixel of the LCD panel 31 and the actually applied voltage.

The rounding unit 273 outputs voltage data for selecting one of the voltage V0–V7 which is indicated by the upper three bits of the 4-bit output data of the adder 271, and stores the least significant bit in the error memory 272 as error data for the same pixel in the next frame.

The response speed of the LCD panel 31 is such that the time need from the point at which the transition of the alignment state of the LC molecules has started upon application of a voltage to the liquid crystal 56 to the point at which the liquid crystal 56 is stabilized to the alignment state according to the applied voltage is equal to approximately one frame period (0.8 frame period to 1.3 frame periods) of a video signal.

The operation of the LCD apparatus according to the third embodiment will be described below with reference to FIGS. 11 through 13.

The converting circuit 215 converts an externally supplied video signal to 2-bit luminance data for each of R, G and B and sends the RGB luminance data to the voltage data generator 217, as per the first embodiment.

The voltage data generator 217 generates 3-bit voltage data from the received RGB luminance data.

The operation of the voltage data generator 217 will now be discussed in the case where the RGB luminance data is "001111" and the error data stored in the error memory 272 is "0000."

In this case, the added value output from the adder 271 for the first frame becomes "0111." The rounding unit 273 outputs the voltage data consisting of the upper three bits for selecting the write voltage V3 and stores "0001" in the error memory 272 as error data for the same pixel in the second frame.

In accordance with the supplied voltage data, the multiplexer 221 selects the write voltage V3 and supplies it to the column driver 33. As a result, the write voltage V3 is held in the pixel capacitor of the associated pixel.

When the RGB luminance data does not change in the next frame, the adder 271 adds the voltage data "0111" and error data "0001" and outputs "1000." The rounding unit 273 outputs the voltage data for selecting the write voltage V4 and sets the error data to "0000." The multiplexer 221 selects the write voltage V4 which is in turn applied to the associated pixel.

The write voltages V3 and V4 are alternately applied to the associated pixel in this manner until the RGB luminance data changes. The alignment state of the liquid crystal 56 repeatedly and almost continuously changes between the alignment state when the write voltage V3 is continuously applied and the alignment state when the write voltage V4 is continuously applied. Accordingly, the display color of the associated pixel repeatedly and continuously changes long the applied voltages v.s. display colors characteristic curve. A series of colors which are displayed during the transition of the alignment state of the liquid crystal 56 are visually combined and the resultant mixed color is recognized by the observer.

When the data output from the color/voltage conversion table 270 is "0110, the least significant bit is "0" so that the output of the rounding unit 273 is always "011." Consequently, the write voltage V3 is continuously applied to the associated pixel. The associated pixel therefore keeps the stable alignment state at the time when the voltage V3 is applied and displays the associated color.

When a still picture or a dynamic image having a gentle motion is to be displayed, it is unlikely that the image drastically and continuously changes so that the driving method of the third embodiment can be used to display an image whose quality is of a practical level.

In this embodiment, the LCD device 25 in which the time need to align the liquid crystal 56 is substantially equal to the frame period of a video signal is used to display a desired color by combining a series of display colors available during the transition of the alignment state of the LC molecules. It is therefore possible to display colors which cannot be displayed by simple voltage application or colors which cannot be displayed stably. Thus, it is possible to display the eight colors available in the stable alignment state and colors obtained by combining the colors available during the transition of the alignment state.

Although the write voltages V3 and V4 are alternately and repeatedly applied to the liquid crystal 56 in the third embodiment, the voltages to be repeatedly applied can be combined arbitrarily. For example, the voltages V1 and V5 or the voltages V3 and V6 may be combined and alternately applied to the liquid crystal 56. Although the third embodiment uses eight types of voltages V0–V7 to be applied to each pixel of the LCD panel 31, the types of the applied voltages may be increased or decreased as needed.

The applied voltages v.s. display colors characteristic differs from one LCD panel to another. In this respect, what colors are displayed when which write voltages are alternately applied to the liquid crystal should be obtained through experiments or the like and voltage data should be set in the color/voltage conversion table 270 based on the attained characteristic.

Although the adder 271, error memory 272 and rounding unit 273 are used to alternately apply different voltages to an associated pixel in the third embodiment, another voltage applying scheme may be used as well.

For example, as shown in FIG. 14, voltage data for odd-numbered frames and data for even-numbered frames are stored in a color/voltage conversion table 280 constituting the voltage data generator 217, so that voltage data for odd-numbered frames and data for even-numbered frames are alternately supplied to the multiplexer 221 in accordance with the count value of a frame counter 281.

Fourth Embodiment

When the response speed of the liquid crystal is slow, the alignment of the liquid crystal hardly changes by the voltage application over one display frame. A description will now be given of an LCD apparatus and a driving method which can display colors specified by video signals in such a case.

This LCD apparatus, like that of the third embodiment, has the circuit structure shown in FIG. 11. The difference however lies in that the voltage data generator 217 comprises a color/voltage conversion table 370 for outputting 6-bit voltage data, adder 371, memory 372 for storing 6-bit error data and rounding unit 373.

The color/voltage conversion table 370 stores 6-bit voltage data indicative of the value of a voltage to be applied to the liquid crystal 56 to display the color which is defined by the RGB luminance data equivalent to an address, at the address position indicated by a video signal consisting of two bits for each of R, G and B, as shown in FIG. 16.

The adder 271 adds 6-bit voltage data, supplied from the color/voltage conversion table 370, and the 6-bit error data read from the error memory 372 and outputs the resultant data consisting of seven bits. The error memory 372 has a capacity for storing one frame of error data, and stores the error between the voltage to be applied to each pixel of the LCD panel 31 and the actually applied voltage.

The rounding unit 373 outputs voltage data for selecting one of the voltages V0–V7 which is closest to the voltage indicated by the 7-bit output data of the adder 371. The write voltages V0–V7 whose values have equal voltage differences expressed by 6-bit binary notations "000000," "001000," "010000," . . . , "110000" and "111000," and the rounding unit 373 outputs voltage data for selecting one of the voltages V0–V7 in eight steps whose value is closest to the 7-bit output data of the adder 371. Further, the rounding unit 373 stores the difference between the output data of the adder 371 and the data indicating the value of the selected voltage in the error memory 372 as error data for the same pixel in the next frame.

This embodiment uses the LCD device 25 whose response speed expressed by the time need to display a predetermined display color according to the applied voltage is relatively slow. The time needed for the liquid crystal 56 to rest in the alignment state according to the applied voltage after the application of that voltage is a period of about two frames (about 30 milliseconds) of a video signal. That is, the response time of the LCD device 25 of this embodiment is longer than one frame period of a video signal.

The operation of the thus constituted LCD apparatus will be described below.

The converting circuit 215 converts an externally supplied video signal to luminance data consisting of two bits for each of R, G and B, and supplies the RGB luminance data to the voltage data generator 217.

The following description will be given with reference to the case where the voltage needed to display the color which is specified by the RGB luminance data for a given pixel is "011100," the error data for that pixel stored in the error memory 372 in the voltage data generator 217 is "000000," the write voltage V3 is equivalent to voltage data "011000" and the write voltage V4 is equivalent to voltage data "100000."

In this case, the adder 370 computes "011100+000000" and outputs the added value "0011100" in the first frame. The rounding unit 373 outputs voltage data for selecting the write voltage V3 having a value of "011000" closest to the added value. Further, the rounding unit 373 computes the difference between the output data of the adder 370 and the voltage value of the selected voltage V3 "0011100–011000"="000100" and stores it in the error memory 372.

In accordance with the voltage data supplied from the voltage data generator 217, the multiplexer 221 selects the write voltage V3 and supplies it to the column driver 33. Consequently, the write voltage V3 is held in the pixel capacitor of the associated pixel of the LCD panel 31.

When the RGB luminance data of video data in the next frame does not change, the adder 371 adds the video data "011100" and error data "000100" and outputs the added value "0100000" in the next frame. The rounding unit 373 outputs the voltage data for selecting the write voltage V4 having a voltage value of "100000" closest to the added value and sets "0100000"–"1000000"="000000" as the error data for the same pixel in the next frame.

The multiplexer 321 selects the write voltage V4 in accordance with the voltage data so that the write voltage V4 is applied to the pixel capacitor of the associated pixel.

The write voltages V3 and V4 are alternately applied to the associated pixel in this manner until the RGB luminance data changes.

As mentioned above, the aligning speed of the liquid crystal 56 is slow and it needs a period of two or more frames until the transition of the alignment is completed. Therefore, the associated pixel of the LCD device 25 displays a color substantially the same as the one displayed when the average value of the write voltages V3 and V4 is applied to that pixel.

Likewise, when the voltage needed to display the color which is specified by the RGB luminance data for a given pixel is "011010" and the error data for that pixel stored in the error memory 372 is "000000," the write voltages are applied to this pixel in the order of V3 to V3 to V3 to V4 to V3 and so forth. Therefore, the associated pixel displays a color substantially the same as the one displayed when the voltages (3·V3+V4)/4 is applied to that pixel.

When the color indicated by the RGB luminance data corresponds to the voltage V3, the color can be displayed by continuously applying the voltage V3.

As discussed above, the fourth embodiment uses the LCD device 25 of the birefringence control type which requires a longer time for the alignment of the liquid crystal 56 than the frame period of a video signal. The voltages to be applied to each pixel are limited to eight types and a color equivalent to the average value of the applied voltages over a plurality of frames is displayed. It is therefore possible to display colors which cannot be displayed by simple voltage application or colors which cannot be displayed stably. Further, the types of the write voltages can be reduced.

Furthermore, the difference between the RGB luminance data and the actually displayed image is reflected as error data in the display contents in the next frame. It is therefore possible to reduce the difference between the image specified by a video signal and the actually displayed image.

Although there are eight types of write voltages V0–V7 and V4 applicable to each pixel of the LCD device 25 in the fourth embodiment, the types of the applied voltages may be increased or decreased as needed. The intervals between the write voltages need not be equal to one another, but may differ from one another. Further, the lower three bits of the write voltages may take other values than "000," as in the case of "011110," "011010" and so forth.

The write voltages may be restricted to those which can display the basic colors, which are displayed by repeatedly applying the associated write voltages while each of the other colors may be acquired by an average voltage of the applied voltages.

According to the first to fourth embodiments, as described above, the number of colors to be actually displayable is limited, and an arbitrary color can be displayed by mixing those colors along the time axis. It is therefore possible to display colors which cannot be displayed by simple voltage application, or display colors which cannot be displayed by simply changing the applied voltages. In addition, it is possible to limit the number of applied voltages so that the consumed power can be decreased. The difference between the desired color to be displayed and the actually displayed color can be reduced.

In the first to fourth embodiments, the write voltages produced by the voltage generator 21 or 219 are selectively supplied to the column driver 33 by the multiplexer 23 or 221. The analog voltages to be supplied to the column driver 33 may be acquired by performing D/A conversion of the voltage data output from the voltage data generator 19 or 217 by means of a D/A converter.

The numbers of bits in each data employed in the first to fourth embodiments are to be considered as simply illustrative and not restrictive, and may be changed as needed.

The structures of the voltage data generators 19, 119 and 217 of the first to fourth embodiments are just illustrative and may be modified as needed. For example, the same function may be realized by a DSP (Digital Signal Processor).

Although the foregoing description of those embodiments has discussed the case where signals of the NTSC system are used as video signals, analog RGB luminance signals supplied from a personal computer may be subjected to A/D conversion being supplied to the voltage data generator. The types of signals are not fixed.

A nematic liquid crystal having the positive dielectric anisotropy is twisted in the LC cell in the LCD panel 31. However, this invention may be adapted for various other types of display devices, such as a DAP (Deformation of Aligned Phase) type which uses a cell having LC molecules in a homeotropic alignment, a parallel aligned nematic (homogeneous) type which uses a cell having LC molecules aligned in a twistless homogeneous form, an HAN (Hybrid Aligned Nematic) type which uses a cell having LC molecules aligned perpendicular on the surface of one substrate and parallel on the surface of the other substrate with the alignment continuously changing between both substrates, and an LC alignment mode type which uses a cell having an LC layer whose LC molecules change between the splay alignment and bend alignment in accordance with the applied voltage.

The retardation plate 52 of the LCD panel 31 may be omitted, or may be added. This invention is not limited to a reflection type LCD device but also to a transparent type LCD device.

What is claimed is:

1. A liquid crystal display apparatus comprising:

a liquid crystal display device having a plurality of pixels arranged in a matrix form, each of said plurality of pixels displaying a plurality of colors, white (which is a non-colored brightest display) and black (which is a non-colored darkest display) in accordance with applied voltages, pixel by pixel;

display color designating means for designating display colors with different brightnesses for said plurality of pixels;

conversion means for converting a display color designated by said display color designating means to data indicating a combination of a plurality of voltages, each representing at least one of a selected color, the white and the black, to be displayed on each pixel over frame sequences;

wherein said conversion means includes means for obtaining a difference between said display color designated by said display color designating means and a color actually displayed by mixing display colors of a plurality of frames, and means for converting said display color designated by said display color designating means to data which indicates a combination of a plurality of voltages to be applied to each pixel over frame sequences, and which is revised in order to lower the obtained difference between the display color designated by said display color designating means and the color actually displayed by mixing display colors of the plurality of frames;

drive means for sequentially applying voltages, each representing said selected color, the white and the black, to said each pixel over the frame sequences in accordance with data from said conversion means;

whereby said display colors having different brightnesses designated by said display color designating means are displayed by mixing plural frames each displaying said selected color, the white and the black, pixel by pixel.

2. The liquid crystal display apparatus according to claim 1, wherein said conversion means includes means for applying a same voltage to a plurality of frames in accordance with a display color designated by said display color designating means, means for applying different voltages to a plurality of frames, and means for selectively driving both means.

3. The liquid crystal display apparatus according to claim 1, wherein said liquid crystal display device has a response speed for displaying a color designated by said display color designating means in each frame period.

4. The liquid crystal display apparatus according to claim 1, wherein said drive means displays a color designated by said display color designating means by visually combining display colors which continuously change in accordance with a change in alignment of a liquid crystal.

5. The liquid crystal display apparatus according to claim 4, wherein said liquid crystal display device has a response time by which alignment of liquid crystal molecules changes in accordance with a voltage to be applied to an associated pixel is substantially equal to a period of voltage to be sequentially applied to a pixel.

6. A method of driving a liquid crystal display device for displaying a plurality of colors having a plurality of brightnesses in accordance with applied voltages pixel by pixel, the method comprising:

a display color designating step of designating display colors with different brightnesses of individual pixels;

a conversion step of converting a display color designated by said display color designating means to data indicating a combination of a plurality of voltages each representing at least one of a selected color, white (which is a non-colored brightest display) and black (which is a non-colored darkest display) to be displayed on each pixel for frame sequences;

wherein said conversion step includes a substep of obtaining a difference between said display color designated by said display color designating means and a color actually displayed by mixing display colors of a plurality of frames, and a substep of converting said display color designated by said display color designating step to data which indicates a plurality of voltages to be applied to each pixel over frame sequences, and which is revised in order to lower the difference between the display color designated by said display color designating step and the color actually displayed by mixing display colors of a plurality of frames based on the obtained difference; and a driving step of sequentially applying voltages, each representing said selected color, the white and the black, to said each pixel for the frame sequences in accordance with data output by said conversion step;

whereby said display colors having different brightnesses designated by said display color designating step are displayed by mixing plural frames each displaying said selected color, the white and the black, pixel by pixel.

7. The method according to claim 6, wherein said display color designating step designates display colors for every n display frames (n being an integer equal to or greater than 2) of individual pixels; and said conversion step outputs an applied voltage to each pixel in n display frames in order to display a color designated by said display color designating step.

8. The method according to claim 7, wherein each pixel of said liquid crystal display device displays image data in said designated display color by visual mixture of colors displayed in said n display frames.

9. The method according to claim 7, wherein each pixel of said liquid crystal display device displays said designated display color by visual mixture of display colors which continuously change in accordance with a change in an alignment state of a liquid crystal in said n display frames.

* * * * *